United States Patent [19]

Gregory

[11] Patent Number: 4,664,671

[45] Date of Patent: May 12, 1987

[54] THERMAL TRANSFER PRINTING CATIONIC DYE WITH SOFT ANIONIC BASE

[75] Inventor: Peter Gregory, Bolton, England

[73] Assignee: Imperial Chemical Industries PLC, London, England

[21] Appl. No.: 786,005

[22] Filed: Oct. 10, 1985

[30] Foreign Application Priority Data

Oct. 16, 1984 [GB] United Kingdom ..... 8426102

[51] Int. Cl.[4] ..... B41M 5/26

[52] U.S. Cl. ..... 8/471; 8/654; 8/655; 8/657; 8/659; 8/922; 346/200

[58] Field of Search ..... 8/471, 654, 655, 657, 8/659

[56] References Cited

U.S. PATENT DOCUMENTS

| | | | |
|---|---|---|---|
| 3,969,071 | 7/1976 | Hugelin | 8/471 |
| 4,057,388 | 11/1977 | Defago et al. | 8/471 |
| 4,367,334 | 1/1983 | Loew | 544/103 |
| 4,382,801 | 5/1983 | Loew | 8/538 |
| 4,452,604 | 6/1984 | Lenox et al. | 8/471 |
| 4,563,191 | 1/1986 | Hahnke et al. | 8/538 |

FOREIGN PATENT DOCUMENTS

| | | |
|---|---|---|
| 55221 | 6/1982 | European Pat. Off. . |
| 55222 | 6/1982 | European Pat. Off. . |
| 97493 | 1/1984 | European Pat. Off. . |
| 59/093391 | 5/1984 | Japan . |
| 59/096993 | 6/1984 | Japan . |
| 59/101395 | 6/1984 | Japan . |
| 1514263 | 6/1978 | United Kingdom . |
| 2033401 | 5/1980 | United Kingdom . |

*Primary Examiner*—A. Lionel Clingman

*Attorney, Agent, or Firm*—Cushman, Darby & Cushman

[57] ABSTRACT

A thermal transfer printing sheet comprising a substrate having a coating comprising a dye of the formula:

D—A wherein

D is a cationic chromophore and

A is a soft anionic base, suitable for use in a thermal transfer printing process.

10 Claims, No Drawings

THERMAL TRANSFER PRINTING CATIONIC DYE WITH SOFT ANIONIC BASE

This specification describes an invention relating to thermal transfer printing (TTP), especially to a transfer sheet carrying a dye or dye mixture, and to a transfer printing process in which dye is transferred from the transfer sheet to a receiver sheet by the application of heat.

In the form of thermal transfer printing with which the present application is concerned, a heat-transferable dye is applied to a sheet-like substrate, in the form of an ink, usually containing a polymeric or resinous binder to bind the dye to the substrate, to form a transfer sheet. This is then placed in contact with the material to be printed, the receiver sheet, and selectively heated in accordance with a pattern information signal whereby dye from the selectively heated regions of the transfer sheet is transferred to the receiver sheet and forms a pattern thereon the shape and density of which is in accordance with the pattern and intensity of heat applied to the transfer sheet.

Important criteria in the selection of a dye for TTP are its thermal properties, brightness of shade, fastness properties, such as light and heat fastness, and facility for application to the substrate in the preparation of the transfer sheet. For suitable performance the dye should transfer evenly, in a predetermined relationship to the heat applied to the transfer sheet so that the depth of shade on the receiver sheet is smoothly related to the heat applied and a good density gradation can be achieved on the receiver sheet. Brightness of shade is important in order to obtain as wide a range of shades with the three primary dye shades of yellow, cyan and magenta.

As the dye must be sufficiently mobile to migrate from the transfer sheet to the receiver sheet at the temperature employed, typically 150°–400° C., it is generally free from ionic and water-solubilising groups, and is thus not readily soluble in aqueous or water-miscible media, such as water and alkanols. Many suitable dyes are also not readily soluble in the solvents which are commonly used in, and thus acceptable to, the printing industry, such as aromatic hydrocarbons, alkanols and alkyl- and cycloalkyl-ketones. Although the dye can be applied as a dispersion in a suitable solvent, it has been found that brighter, glossier and smoother final prints can often be achieved on the receiver sheet if the dye is applied to the substrate from a solution. To apply sufficient dye to the transfer sheet, and thereby to achieve the potential for a deep shade on the receiver sheet, it is desirable that the dye should be readily soluble in the ink medium, particularly if it has a relatively low extinction coefficient. It is also important that a dye which has been applied to a transfer sheet from a solution should be resistant to crystallisation so that it remains as an amorphous layer on the transfer sheet for a considerable time.

According to the present invention there is provided a thermal transfer printing sheet comprising a substrate having a coating comprising a dye of the formula:

D—A I wherein

D is a cationic chromophore and

A is a soft anionic base.

The cationic chromophore, D, preferably incorporates a positively charged ammonium or phosphonium group although the charged is not necessarily localised at this group and dyes having chromophores in which the charge is delocalised are preferred species of the present invention. Examples of chromophores having delocalised charges are:

hemicyanines & diazahemicyanines of the general formulae:

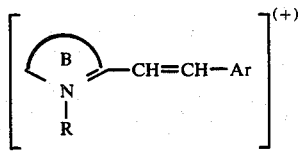

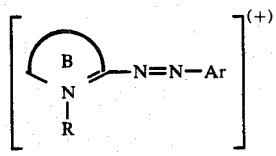

azacarbocyanines of the formulae:

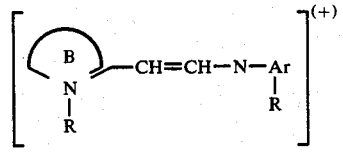

and

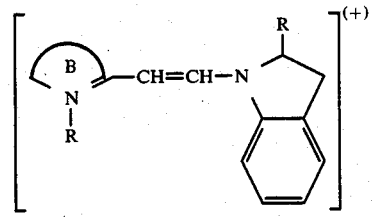

diazacarbocyanines of the formula:

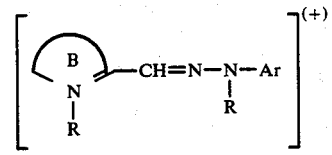

oxazines, thiazines and phenazines of the formula:

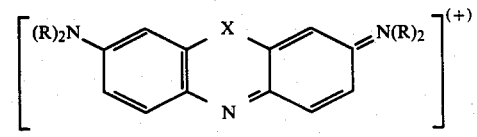

wherein X is O, S or N—R respectively, di- and tri-arylmethanes of the general formula:

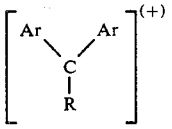

and naphtholactams of the formula:

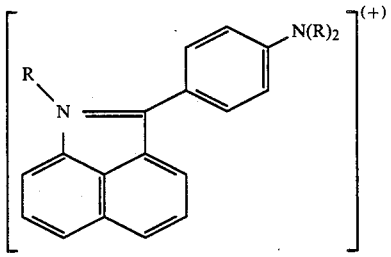

Examples of chromophoric cations in which the charge is localised on a nitrogen atom are, pyridine derivatives of azobenzenes of the formula:

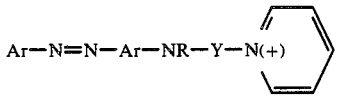

pyridine derivatives of azopyridones of the formula:

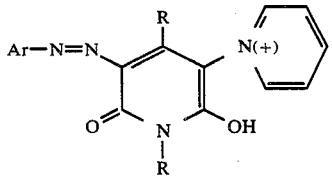

and anthraquinones of the general formula

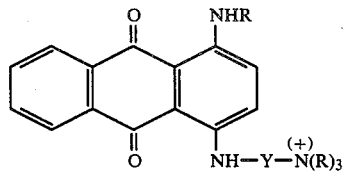

In the above formulae:

R is H, alkyl, preferably $C_{1-4}$-alkyl, or mono- or bi-cyclic aryl or heteroaryl, such as phenyl, pyridyl or naphthyl, Ar is an aryl or heteroaryl group, preferably mono- or bi-cyclic, such as phenyl, pyridyl or naphthyl,;

B is an aromatic mono- or polycyclic group, preferably comprising a five membered heterocycle, optionally fused to a benzene ring; &

Y is a bridging group which is preferably $C_{1-4}$-alkylene or arylene, especially 1,4-phenylene.

Examples of the mono- and polycyclic groups represented by B are 1(2),4-dimethyl-1,2,4-triazol-5-ylinium and 1,3,3-trimethylindol-2-ylinium.

A 'soft' base is defined in an article by R. G. Pearson in Chemistry in Britain 3, 103–7 (1967) as one in which the valence electrons are easily distorted, i.e. polarised, or removed. The softness or hardness of a base can be assessed by determination of the rate constants for reaction of the base with the platinum complex, trans-$[Pt(py)_2Cl_2]$, in which py is pyridine, in methanol at 30° C. From the rate constants for the reaction of each base with the platinum complex it is possible to calaculate a nucleophilic reactivity constant ($n_{Pt}$) in accordance with the equation, $$n_{Pt} = \log (k_Y/k_S)_o$$

in which $k_Y$ and $k_S$ are the rate constants for the reaction of the base with the platinum complex and the solvent respectively. The procedure for determination of the nucleophilic reactivity constants is described in more detail in an article by Belluco et al in JACS, 87, 241–6 (1965).

It is preferred that the soft anionic base, A, has a nucleophilic reactivity constant ($n_{Pt}$) greater than three and more preferably at least four. Examples of suitable soft anionic bases represented by A are $I^-$, $SCN^-$, $BF_4^-$, $RS^-$, $S_2O_2^{3-}$, $CN^-$, $ZCS_2^-$, $ZCOS^-$ and $ZCO_2^-$ wherein Z is alkyl, especially $C_{1-4}$-alkyl, or aryl, especially phenyl.

The alkyl and aryl groups represented by, or contained in, R, Ar, B & Z and the benzene, naphthalene and heterocyclic rings shown in the above formulae for D may be substituted. Examples of suitable substituents are OH, $NH_2$, CN, $NO_2$, $C_{1-4}$-alkoxy and halo; the aryl groups may also be substituted by $C_{1-4}$-alkyl, $C_{1-4}$-alkoxycarbonyl and substituted amino, especially mono- and di-$C_{1-4}$-alkylamino, $C_{1-4}$alkylcarbonylamino- and mono- and di-phenyl-amino.

Specific examples of preferred dyes of Formula I are, the red diazahemicyanines, 1(2),4-dimethyl-5-(4-[diethylamino]phenylazo)-1,2,4-triazolium iodide, tetrafluoroborate and thiocyanate, the blue phenoxazine, 3,7-bis(diethylamino)-3H-phenoxazine iodide and the yellow azacarbocyanines, 2-[N'-methyl-N'-(4-methoxyphenyl)hydrazono]- & 2-[2-(4-methoxyanilino)vinyl]-1,3,3-trimethylindoleninium iodide.

The dyes of Formula I have strong bright shades and are readily soluble in a wide range of solvents, especially those solvents which are widely used and accepted in the printing industry, such as alkanols, e.g. ethanol, isopropanol & butanol, aromatic hydrocarbons, such as toluene and ketones such as MEK, MIBK and cyclohexanone. This facilitates the application of the dye to the substrate from a solution and thus aids in the achievement of bright, glossy prints on the receiver sheet. The combination of good coloristic properties and high solubility in the preferred solvents allows the achievement of deep and even shades.

The basic dyes of Formula I have relatively high molecular weights compared with the dyes used in conventional textile transfer printing and are also ionic in character. It is therefore, surprising that they give excellent prints in TTP, i.e. even coloration, with depth of shade in good relationship with the applied heat, and thus an even gradation of color density. The dyes are capable of giving strong bright shades under TTP application conditions, with good lightfastness.

Many of the dyes of Formula I are commercially available in the form of salts of soft anionic bases, especially iodides, and those that are not can be prepared from commercially available dyes by double decomposition as described in UK 2,033,401A.

The substrate may be any convenient sheet material capable of withstanding the temperatures involved in TTP, up to 400° C. over a period of up to 20 milliseconds (msec), yet thin enough to transmit heat applied on one side through to the dye on the other side to effect transfer to a receiver sheet within such short periods, typically from 1 to 10 msec. Examples of suitable materials are paper, especially high quality paper of even thickness, such as capacitor paper, polyester, polyacrylate, polyamide, polyurethane, polyacrylonitrile, cellulosic and polyalkylene films, metallised forms thereof, including co-polymer and laminated films, especially laminates incorporating a polyester layer on which the dye is deposited. Such laminates preferably comprise, in addition to the polyester, a backcoat of a heat-resistant material, such as a thermosetting resin, e.g. silicone or polyurethane, to separate the heat source from the polyester so that the latter is not melted. The thickness of the substrate may vary within wide limits depending upon its thermal characteristics but is preferably less than 50 μm, more preferably below 20 μm and especially from 4 to 10 μm. Examples of suitable supports are given in EP 97 493, at page 11.

The coating preferably comprises a binder and one or more dyes of Formula I. The ratio of binder to dye is preferably at least 1:1 and more preferably from 1.5:1 to 4:1 in order to provide good adhesion between the dye and the substrate and inhibit migration of the dye during storage.

The binder may be any resinous or polymeric material suitable for binding the dye to the substrate. Examples of suitable binders are cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicones, such as polysiloxanes, epoxy resins and natural resins, such as gum tragacanth and gum arabic.

Preferred binders are soluble in organic solvents so that they may be applied to the support as a solution and the solvent evaporated to leave a thin even layer of binder. Other methods of applying the binder are by lamination or by polymerisation of an appropriate monomer on the surface of the support. Where the binder is a crosslinked linear polymer, a binder layer, preferably incorporating the dye, may be formed by dissolving or dispersing the binder in its linear polymeric form, and also the dye, in a solvent, applying this to the support, evaporating the solvent and curing the binder to leave a heat resistant layer of crosslinked polymer, preferably containing the dye.

The coating may also contain other additives, such as curing agents, preservatives, etc., these and other ingredients being described more fully in EP 133011A, EP 133012A and EP 111004A.

The layer of dye and binder is desirably $<5$ μm thick, preferably from 0.5 to 4 μm and more preferably from 1 to 4 μm. The quantity of dye on the support is preferably from $10^{-2}$ to 10 g/m$^2$.

According to a further feature of the present invention there is provided a transfer printing process which comprises contacting a transfer sheet coated with a dye of Formula I with a receiver sheet, so that the dye is adjacent to the receiver sheet, and selectively heating areas of the transfer sheet whereby dye in the heated areas of the transfer sheet may be selectively transferred to the receiver sheet.

The receiver sheet conveniently comprises a white polyester sheet material, preferably having a receptive coating layer on the side to which the dye is applied.

Dyes of Formula I above generally transfer more readily and/or give better images, with higher gloss, higher strength and/or better definition, than basic dyes which are salts of cationic chromophores with a hard anionic bases, such as $Cl^-$ or $SO_4^{-2}$, e.g. CI Basic Blue 3, CI Basic Red 22 and CI Basic Yellow 28, or volatile disperse dyes, such as CI Disperse Blue 14, CI Disperse Red 60 and CI Disperse Yellow 3, which are used in the conventional transfer printing of textiles.

The invention is further illustrated by the following examples in which all parts are by weight unless otherwise indicated.

Ink 1

To a solution of 0.1 g of the dye, 2-[2-(4-methoxyanilino)vinyl]-1,3,3-trimethylindolinium iodide, in 5 ml of chloroform was added 9.5 ml of a 2.7% solution of EHEC (extra-low viscosity grade) in chloroform.

Ink 2

To a solution of 0.1 g of the dye, 2-[2-(2-methylindolin-1-yl)vinyl]-1,3,3-trimethylindolinium iodide, in 5 ml of chloroform was added 9.5 ml of a 2.7% solution of EHEC (extra-low viscosity grade) in chloroform.

Ink 3

To a solution of 0.1 g of the dye, 2-[N'-(4-methoxyphenyl)-N'-methylhydrazonomethyl]-1,3,3-trimethylindolinium iodide, in 5 ml of chloroform was added 9.5 ml of a 2.7% solution of EHEC (extra-low viscosity grade) in chloroform.

Ink 4

To a solution of 0.1 g of the dye, 1-[2,6-dioxo-4-methyl-3-(2-nonyloxycarbonylphenylhydrazono)-1,2,3,6-tetrahydropyrid-5-yl]pyridinium iodide, in 5 ml of chloroform was added 9.5 ml of a 2.7% solution of EHEC (extra-low viscosity grade) in chloroform.

Ink 5

To a solution of 0.1 g of the dye, 1(2),4-dimethyl-5-(4-dimethylaminophenylazo)-1,2,4-triazolium iodide, in 5 ml of chloroform was added 9.5 ml of a 2.7% solution of EHEC (extra-low viscosity grade) in chloroform.

Ink 6

To a solution of 0.1 g of the dye, 3-ethylimino-2-methyl-7-(2-methylanilino)-3H-phenoxazine hydroiodide, in 5 ml of chloroform was added 9.5 ml of a 2.7% solution of EHEC (extra-low viscosity grade) in chloroform.

Ink 7

To a solution of 0.1 g of the dye, 3-diethylimino-7-(2-methylanilino)-3H-phenoxazine iodide, in 5 ml of chloroform was added 9.5 ml of a 2.7% solution of EHEC (extra-low viscosity grade) in chloroform.

Ink 8

To a solution of 0.1 g of a 1:1 mixture of the dyes used in Inks 6 and 7 above, in 5 ml of chloroform was added 9.5 ml of a 2.7% solution of EHEC (extra-low viscosity grade) in chloroform.

Ink 9

To a solution of 0.1 g of the dye, 3-[1-(4-amino-3,5-dimethylphenyl)-1-(2,6-dichlorophenyl)methylidene]-1,5-dimethyl-6-imino-1,4-cyclohexadiene hydroiodide, in 5 ml of chloroform was added 9.5 ml of a 2.7% solution of EHEC (extra-low viscosity grade) in chloroform.

Ink 10

To a solution of 0.1 g of the dye, 6-chloro-2-(4-diethylaminophenyl)-1-methylbenz[cd]indolium iodide, in 5 ml of chloroform was added 9.5 ml of a 2.7% solution of EHEC (extra-low viscosity grade) in chloroform.

Ink 11

To a solution of 0.1 g of the dye, 1-[2-(N-ethyl-3-methyl-4-[5-nitrothiazol-2-ylazo]anilino)ethyl]-pyridinium iodide, in 5 ml of chloroform was added 9.5 ml of a 2.7% solution of EHEC (extra-low viscosity grade) in chloroform.

Ink 12

To a solution of 0.1 g of the dye, 1-methylamino-4-(3-trimethylammoniopropylamino)anthraquinone iodide, in 5 ml of chloroform was added 9.5 ml of a 2.7% solution of EHEC (extra-low viscosity grade) in chloroform.

Example 1

A transfer sheet was prepared by applying Ink 1 to a sheet of 6μ thick polyethylene terephthalate using a wire-wound metal Meyer-bar to produce a 24 micron wet film of ink on the surface of the sheet. The ink was dried with hot air and the sheet is hereinafter referred to as TS1.

Examples 2 to 12

Transfer sheets, TS2 to TS12, were prepared by the method of Example 1 using Inks 2 to 12 respectively, in place of Ink 1.

Example 13

A sample of TS1 was sandwiched with a receiver sheet, comprising a composite structure based on a white polyester base having a receptive coating layer on the side in contact with the printed surface of TS1. The sandwich was placed on the drum of a transfer printing machine and passed over a matrix of closely-spaced pixels which were selectively heated in accordance with a pattern information signal to a temperature of >300° C. for periods from 2 to 10 msec, whereby at least some of the dye at the position on the transfer sheet in contact with a pixel while it was hot was transferred from the transfer sheet to the receiver sheet. After passage over the array of pixels the transfer sheet was separated from the receiver sheet The printed receiver sheet is hereinafter referred to as RS1.

Examples 14 to 24

Receiver sheets, RS2 to RS12 respectively, were prepared by the method of Example 13, using transfer sheets TS2 to TS12 respectively, in place of TS1.

Assessment of Printed Receiver Sheets

The quality of the printed impression on each receiver sheet was assessed in respect of reflected optical density by means of a densitometer (Sakura Digital densitometer). The reflected optical densities of the coloured images on the receiver sheets are given in the following table.

TABLE

| Receiver Sheet | Reflected Optical Density of Image |
|---|---|
| RS 1 | 0.52 |
| RS 2 | 0.70 |
| RS 3 | 0.59 |
| RS 4 | 0.36 |
| RS 5 | 0.99 |
| RS 6 | 0.82 |
| RS 7 | 0.94 |
| RS 8 | 0.83 |
| RS 9 | 0.75 |
| RS 10 | 0.60 |
| RS 11 | 0.45 |
| RS 12 | 0.24 |

I claim:

1. A thermal transfer printing process which comprises contacting a transfer sheet, coated with a dye of the formula: D—A wherein D is a cationic chromophore and A is a soft anionic base, and a receiver sheet so that the dye is adjacent to the receiver sheet and selectively heating areas of the transfer sheet at a temperature of from 300° C. to 400° C. for a period of from 1 to 10 msec. whereby dye in the heated areas of the transfer sheet may be selectively transferred to the receiver sheet.

2. A thermal transfer printing process according to claim 1 wherein the cationic chromophore D incorporates a positively charged ammonium or phosphonium group.

3. A thermal transfer printing process according to claim 2 wherein the charge on the ammonium or phosphonium ion is delocalised.

4. A thermal transfer printing process according to claim 2 wherein the chromophore is selected from, (i) hemicyanines and diazahemicyanines of the formulae

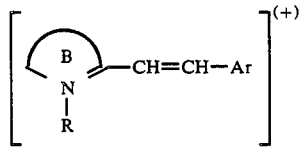

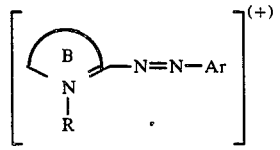

(ii) azacarbocyanines of the formulae:

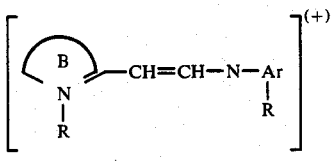

and

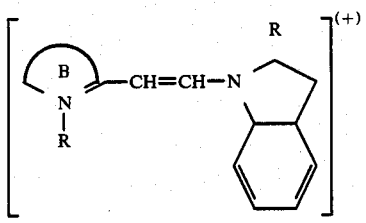

(iii) diazacarbocyanines of the formula:

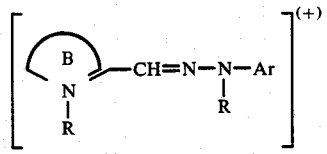

(iv) phenoxazines, phenothiazines and phenazines of the formula:

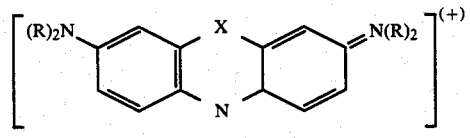

wherein X is O, S or N—R respectively, (v) di- and tri-arylmethanes of the general formula:

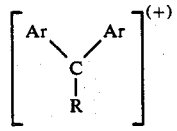

(vi) naphtholactams of the general formula:

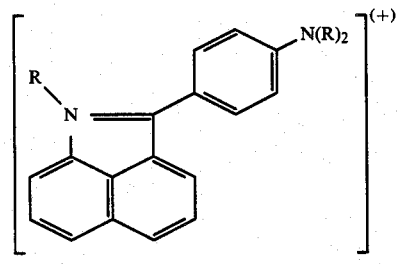

(vii) pyridine derivatives of azobenzenes of the formula:

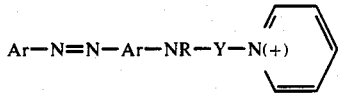

(viii) pyridine derivatives of azopyridones of the formula:

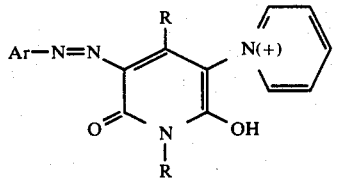

and (ix) anthraquinones of the formula:

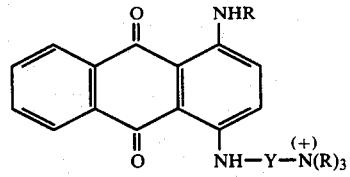

wherein

R is selected from H, $C_{1-4}$-alkyl, mono- and bi-cyclic aryl and heteroaryl;

Ar is selected from mono- and bi-cyclic aryl and heteroaryl;

B is mono- or bi-cyclic heteroaryl comprising a five-membered heterocycle, optionally fused to a benzene ring, either or both of which may be substituted, and Y is $C_{1-4}$-alkylene or 1,4-phenylene.

5. A thermal transfer printing process according to claim 1 wherein A has a nucleophilic reactivity constant greater than four.

6. A thermal transfer printing process according to claim 1 wherein A is selected from $I^-$, $SCN^-$, $BF_4^-$, $RS^-$, $S_2O_3^{2-}$, $CN^-$, $ZCS_2^-$, $ZCOS^-$ and $ZCO_2^-$ wherein Z is $C_{1-4}$-alkyl or phenyl.

7. A thermal transfer printing process according to claim 1 wherein the coating comprises a resinous or polymeric binder to provide adhesion between the dye and the substrate.

8. A thermal transfer printing process according to claim 7 wherein the binder is ethylhydroxyethylcellulose.

9. A thermal transfer printing process according to claim 1 wherein the substrate is a flexible sheet material with a thickness of less than 50 micrometers and capable of withstanding a temperature up to 400° C. for a period of 20 milliseconds.

10. A transfer printing process according to claim 1 wherein the receiver sheet is a white polyester sheet material.

* * * * *